US008069632B2

(12) United States Patent
Li

(10) Patent No.: US 8,069,632 B2
(45) Date of Patent: Dec. 6, 2011

(54) INTEGRALLY ASSEMBLED CHANGEABLE FRAMEWORK CONNECTOR USED FOR A SPATIAL STRUCTURE

(76) Inventor: Piao-Chin Li, Sihu Township, MiaoLi County (TW)

( * ) Notice: Subject to any disclaimer, the term of this patent is extended or adjusted under 35 U.S.C. 154(b) by 140 days.

(21) Appl. No.: 12/385,817

(22) Filed: Apr. 21, 2009

(65) Prior Publication Data

US 2009/0313938 A1 Dec. 24, 2009

(30) Foreign Application Priority Data

Jun. 20, 2008 (TW) ..... 97123000 A

(51) Int. Cl.
*E04E 3/02* (2006.01)
*E04E 3/28* (2006.01)

(52) U.S. Cl. ..... 52/646; 52/645; 52/656.9; 52/653.2; 52/655.1

(58) Field of Classification Search ..... 52/651.01, 52/651.07, 651.08, 651.1, 652.1, 653.2, 653.1, 52/655.1, 656.9, 648.1, 645, 646, 649.5, 52/649.6, 638; 434/278, 281, 211; 446/126, 446/124

See application file for complete search history.

(56) References Cited

U.S. PATENT DOCUMENTS 2,001,215 A * 5/1935 Ruppel ..... 52/653.2
3,011,586 A * 12/1961 Harvey, Jr. ..... 182/115
3,600,825 A * 8/1971 Pearce ..... 434/403
3,921,360 A * 11/1975 Baldwin ..... 52/655.2
4,129,975 A * 12/1978 Gabriel ..... 52/655.2
5,036,641 A * 8/1991 Viry ..... 52/646
5,238,438 A * 8/1993 Glickman ..... 446/126
5,265,395 A * 11/1993 Lalvani ..... 52/648.1
5,318,470 A * 6/1994 Denny ..... 446/126
5,326,337 A * 7/1994 Pardella ..... 482/36
5,839,248 A * 11/1998 Liang ..... 52/655.2
6,315,628 B1 * 11/2001 Quercetti ..... 446/128
6,378,265 B1 * 4/2002 Konstandt ..... 52/655.2
6,447,360 B1 * 9/2002 Sorensen ..... 446/124
6,584,918 B2 * 7/2003 Lee ..... 108/155
6,648,715 B2 * 11/2003 Wiens et al. ..... 446/121
7,204,064 B2 * 4/2007 Cazzolaro ..... 52/645

* cited by examiner

*Primary Examiner* — Phi Dieu Tran A
(74) *Attorney, Agent, or Firm* — Rosenberg, Klein & Lee

(57) ABSTRACT

An integrally assembled changeable framework connector used for a spatial structure includes a framework, a predetermined quantity of protruded connecting bases and a specific quantity of positioning element. The framework is a predetermined shaped axial rod, which acts as a main body of the whole connector. The protruded connecting base has a specific quantity of protruding bodies extended in different positions and directions and disposed on a predetermined shaped base body and along the peripheral surface of the framework, and fixed onto the framework by a positioning element to form a connector used for connecting various different spatial structures in any direction and position. An axial pipe and a lateral connecting element are used for connecting the connectors to form the spatial structure. The shapes of the framework, the protruded connecting base and the positioning element can be changed to fit the shape and the connection of the spatial structure.

6 Claims, 11 Drawing Sheets

INTEGRALLY ASSEMBLED CHANGEABLE FRAMEWORK CONNECTOR USED FOR A SPATIAL STRUCTURE

BACKGROUND OF THE INVENTION

1. Field of the Invention

The present invention relates to an integrally assembled changeable framework connector used for a spatial structure, in particular to a connector capable of fitting various different structural requirements by integrating the connector with a framework to form a protruded connecting base and changing the form and assembling relation of the framework and the protruded connecting base.

2. Description of the Related Art

In general, structure connectors are provided for connecting and combining components, and rigid or hinge joints so formed can be used for transmitting and distributing loads exerted onto each component. At present, the structure connectors are implemented by either a direct method or an indirect method. The direct method refers to a method of connecting components without using a special connecting structure; for example, a beam is welded directly onto a column, or a beam is combined and connected by welding. The indirect method refers to a method of connecting components by adding transitional components or special connecting assemblies, and the indirect methods generally include bracket, clamp, sleeve, latch slot, and point connecting types. The bracket type refers to the type of applying a force to a component to extend a bracket or a nib and connecting other components together with the bracket by welding or screwing bolts. The clamp type refers to the type of using two bundled metal plates or steel corners as connecting elements to connect two components. The sheath type refers to the type of using a sheath to connect a component to another component. The latch slot type refers to the type of designing a special latch opening or slot on a pre-made element for connecting two components with each other, and the latch slot type has been disclosed in U.S. Pat. No. 5,305,571. The point connecting type refers to the type of using a connecting element such as a bolt ball for connecting components, and the point connecting type has been disclosed in U.S. Pat. Nos. 2,709,318A, 3,864,049, 5,074,094, 5,305,571 and 6,234,715.

From the description above, the conventional structure connectors, regardless of the direct method or the indirect method, do not come with a flexibility of connecting components in different directions when the connector is used for connecting components of a structure, and the connector components are not changeable. In the meantime, the connector components do not have any freedom or capability of connecting components at the same connecting point of the connector by various different connecting methods, and thus making the structure construction more complicated, and failing to fit various different requirements of the structure. Obviously, the prior art requires further improvements.

SUMMARY OF THE INVENTION

It is a primary object of the invention to provide an integrally assembled changeable framework connector used for a spatial structure, and the connector can meet the requirement of being assembled from different directions and positions and the assembling components can be changed as needed, so as to provide a quicker, simpler, and easier structure construction and meet the requirements of various different structures.

The present invention bases on the principle of bionics and the assembly of trunks, nodes, and branches of a plant or a spine of an animal as well as a structure fusion method to develop an integrally assembled changeable framework connector. The connector comprises a framework, a predetermined quantity of protruded connecting bases, and a predetermined quantity of positioning elements. The framework is similar to a segment of a trunk of a plant or a vertebra of a spine of an animal, and thus the framework is a core of the connector mainly used for integrating the protruded connecting base. The protruded connecting base is similar to a tip of a branch of a plant or a base of a bone, and the protruded connecting base is pre-made on the base body for installing protruding bodies protruded from different positions. The extended protruding body is mainly used for connecting connectors by a connecting element. Analogously, fibers are provided for connecting a trunk and branches of a plant, and muscles are provided for connecting a body and limbs, while the integrally assembled changeable framework connector of the present invention uses a positioning element for connecting the framework and the protruded connecting base.

In the integrally assembled changeable framework connector, the framework is a rod in a predetermined shape to act as a main body of the connector and is used mainly for connecting and assembling the protruded connecting base. The rod can be in a circular, square or polygonal shape and a structure for installing the protruded connecting base thereon to limit its displacement or rotation. The protruded connecting base is disposed on a base body in a predetermined shape for installing protruding bodies extended from different positions and directions, and the protruding bodies can be in a circular, square or polygonal shape and has a thread, a screw hole or a latch slot for connecting the connecting element.

The integrally assembled changeable framework connector comprises a framework used as a main body, a protruded connecting base built around the periphery of the framework by either a sheathing method or not a sheathing method and secured with the framework by a positioning element to constitute the connector. In the sheathing method, the framework is passed through a hollow portion of the structure, and the base body of the protruded connecting base is sheathed onto the framework, such that the framework and the positioning element limit the protruded connecting base from moving in different directions, and the rotation of the protruded connecting base is related to the shape of the rods between the protruded connecting base and the framework. If both of the framework and the base body of the protruded connecting base are circular rods or one of them is a circular rod, then the base body of the protruded connecting base can be rotated freely with respect to the axis of the framework on the structure. The torque moment exerted onto the rotating direction is resisted and born by the connecting elements connected to the protruded connecting base and then transmitted and distributed to the whole structure. If it is necessary to limit the rotation to a certain level to have a partial rotation, then corresponding accessories should be installed on the framework and the base body of the protruded connecting base respectively to achieve the expected effect. For example, the latch slot is disposed on either the framework or the base body and a protruding wedge is installed at the remaining base body or framework. To completely restrict the rotation, both of the framework and the base body of the protruded connecting base are in a square shape or a polygonal shape, such that the rotation can be restricted completely. In the structure, a torque moment produced by rotations is exerted onto the latter two, and all of the connecting elements of the connector of the former are used jointly to resist and bear the torque moment and the latter primarily uses the axial pipe connected to the connector framework for the resistance and bearing. It is known that a different way of connecting the framework with the protruded connecting base gives rise to a different behavior of the structure.

In the non-sheathing method, the protruded connecting base is disposed around the peripheral surface of the framework and connected by a non-sheathing method. Unlike the sheathing method, the protruded connecting base is displaced in different directions and limited by the positioning element. In a certain situation, accessories are installed on the framework for limiting the protruded connecting base, and the accessories can be used for providing further limitation of the positioning element. In addition, the way of rotating and connecting the protruded connecting base may vary, and there are two types of rotations provided here, namely: a first type of rotating with respect to the axis of the framework, and a second type of rotating with respect to the axis of the base body of the protruded connecting base. These two types of rotations are related to the shape of the positioning element in addition to the shapes of the framework and the protruded connecting base. For example, the base body of the protruded connecting base is in a circular shape, but the other two are not in a circular shape, so that there is the second type of rotations only. If all of the positioning element, the framework and the protruded connecting base are in a circular shape, then there exists the second type of rotations, so that the accessories of the framework can limit the rotation. For example, a wedge groove is concavely disposed on the framework, and the base body of the protruded connecting base is used as a protruded wedge for limiting the first type of rotations, and the second type of rotations can be applied partially. From the description above, we know that the framework and the protruded connecting base are rigid joints or hinge joints, and are related to the shapes of the framework, the base body of the protruded connecting base, and the positioning element, and thus the connecting relation of the rods and the shape of the positioning element can be changed according to the requirement of the connector of the structure to fit various different requirements. In addition, the connector is comprised of a framework, a predetermined quantity of protruded connecting bases and a specific quantity of positioning element, wherein each of the protruded connecting bases can have a different shape of the base body. In other words, a base body of a protruded connecting base can be connected with a framework by a rigid joint in a connector, but a base body of another protruded connecting base can be connected to the framework by a hinge joint. Meanwhile, the positioning element can be disassembled, or used for securing and connecting the framework and the protruded connecting base in different ways, and used in a combination either by a sheathing method or a non-sheathing method in the connector, such that the integrally assembled changeable framework connector can be used more extensively.

The integrally assembled changeable framework connector is a connector for a connection in any direction and position. In other words, the direction, position and angle of the connector structure can be adjusted anytime as needed. For example, the directions of the X-axis, Y-axis or Z-axis can be in any direction of a space, and the connector can use the framework and the protruded connecting base for connecting the pipe and the connecting element, and the framework can be connected directly or indirectly. In the direct method, no intermediate component is required, but welding, screw threads, bolts and embedment are used for connecting the framework and the pipe instead. The indirect method uses an intermediate component such as a screw for connecting the framework and the pipe, and the rest is the same as the direction method. In general, a component of the structure mainly for bearing forces is used as a connecting element of the framework to constitute a structure with beam and column frameworks, and the connector is the connecting point of the structure. The protruded connecting base is also connected directly or indirectly, and the arrangement of the framework is the same as described above, except that the framework can be connected by a rigid joint if necessary, and the protruded connecting base can be connected by either a rigid joint or a hinge joint, depending on the type and the shape of the desired constructing structure.

In addition, the protruded connecting base and the connecting element can be a structure with the beam and column frameworks, and the connector acts as the connecting point. When the connector is assembled, the shape of the framework of the connector can be adjusted or changed according to the construction way and the type of the structure, and the shape of the protruded connecting base and the quantity of the protruded connecting bases can be adjusted to meet the construction requirements of the structure, and thus rigid and hinge joints can be used in a same connector, and a frame structure can include a truss structure or any other structure. The features of the connector give tremendous convenience to the construction of a curved-line or folded-line structure. The connector can be used as a connecting point for the structure and the accessory construction as well as a start point for expanding the structure, so as to achieve the effect of making an appropriate adjustment or change by using the connectors effectively.

In view of the description above, the integrally assembled changeable framework connector of the present invention not only differs from other connectors, but also has unique advantages to meet the requirements for the construction and the applications of various different structures.

In the connector structure, there are two types of positioning elements for connecting the framework with the protruded connecting base, wherein the first type is to restrict the displacement of the base body of the protruded connecting base along the axial direction of the framework, and the second type is to restrict the displacement of the base body of the protruded connecting base along the axial direction of the framework. Both types jointly restrict the displacement of the protruded connecting base in each direction and secure the protruded connecting base onto the framework. The limitation of the rotations of the positioning element with respect to the protruded connecting base depends on the construction type and the assembling method of the structure, and two types of positioning elements can be combined with each other as a whole, and the positioning element can be used for limiting each direction of the displacement of the protruded connecting base. Meanwhile, the framework of a sheathing type connector of the structure not only uses the connector as a core, but also restricts the displacement of the base body of the protruded connecting base in a direction perpendicular to the axis of the framework. In other words, the framework concurrently having a second type of positioning element actions without a sheathing type structure can install an accessory such as a wedge groove to achieve a framework that concurrently has the effect of the second type of positioning element.

According to the invention, an integrally assembled changeable framework connector used for a spatial structure includes:

a) a framework, formed by a predetermined quantity of protruded connecting bases and a predetermined quantity of positioning elements, wherein the framework is an axial rod in a predetermined shape and acts a main body of the whole connector; the protruded connecting base includes a base body disposed at an external periphery of the framework, and a protruding body extended radially outward from a surface of the framework and having a plurality of levels provided for connections in different directions, and the protruding bodies including bodies in a same shape or different shapes; and b) at least two positioning elements, installed to upper and lower ends of the framework axially and respectively, such that the upper and lower ends of the framework constitute an axial coupling portion, and two upper and lower positioning elements fix the protruded connecting base onto the framework, and the three constitute a connector, and the axial coupling portion and radially extended protruding bodies of different directions, positions, and angles between corresponding connectors are assembled by axial pipes and lateral connecting elements to form a spatial structure in a predetermined shape.

In this way, the integrally assembled changeable framework connector of the present invention can be used extensively in the areas of civil engineering and construction, and the connector can be applied to a force bearing structure as disclosed in the inventor's patented impact protection structure (R.O.C. Pat. No. 271463) to make the construction more convenient and easier and provide a better impact protection function. The connector can also be applied to a soft framework or a soft skeleton of a plat-growing net combined with a water and soil conservation engineering method (as disclosed in R.O.C. Pat. No. 284168) to provide diversified functions to the assembly and use of the soft skeleton. In addition, the connector can be used in a suspecting-arm support column assembly of a truss type dam and a wall structure, and the connector not only provides an external connection for the supporting-arm structure, but also provides diversified functions to the truss type structure. Obviously, the integrally assembled changeable framework connector can be used extensively in many different areas, but not limited to civil engineering or constructions only.

DETAILED DESCRIPTION OF THE PREFERRED EMBODIMENT

Figure 1:
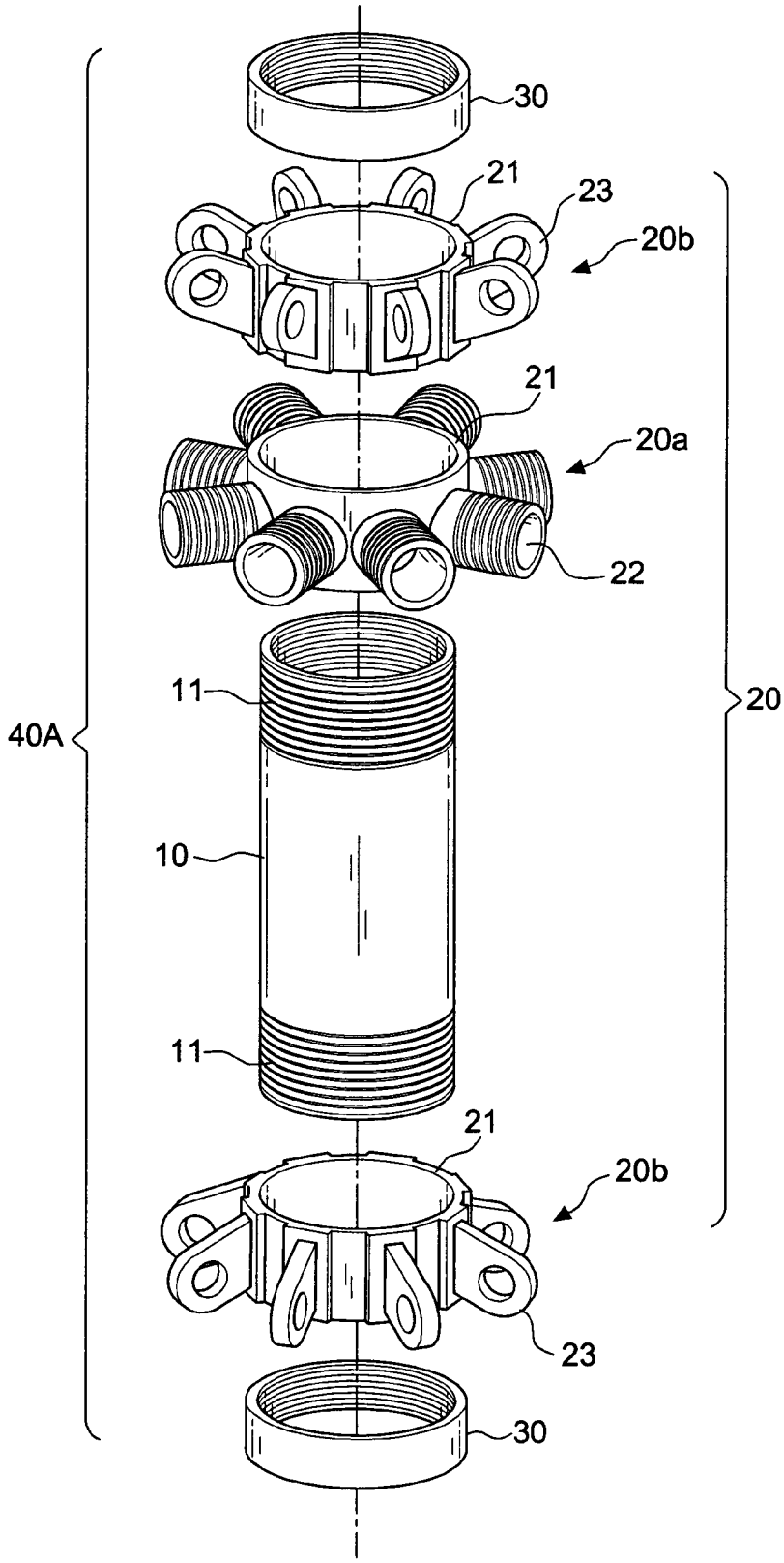
FIG. 1 is an exploded view of a first preferred embodiment of the invention.
Figure 3:
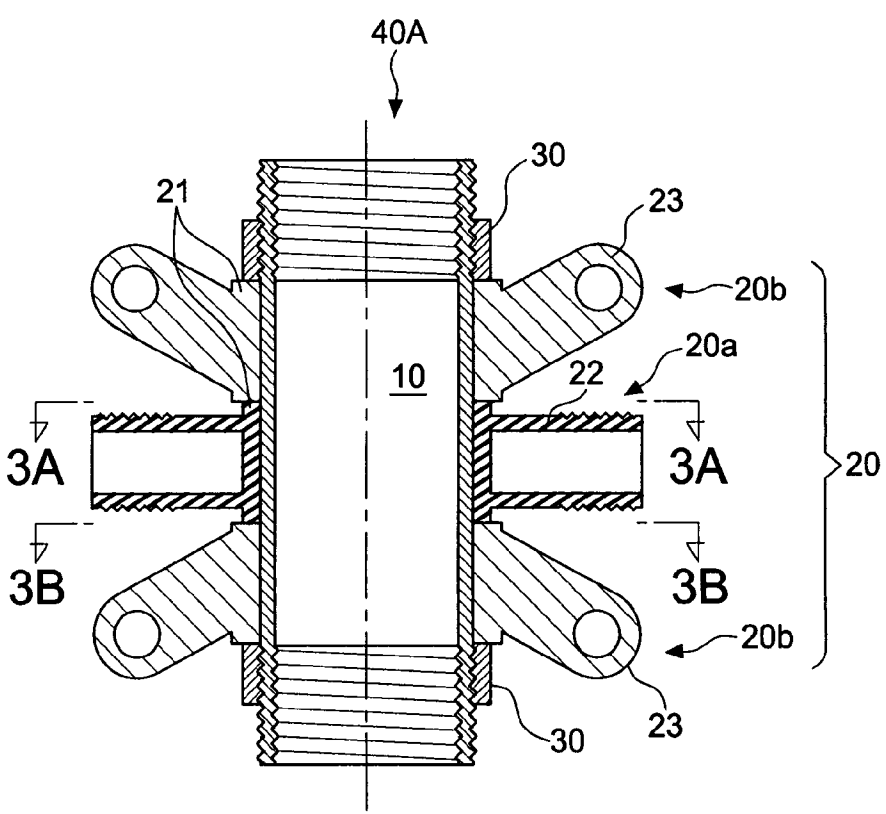
FIG. 3 is a cross-sectional view of Section 3-3 as depicted in FIG. 2.
Figure 2:
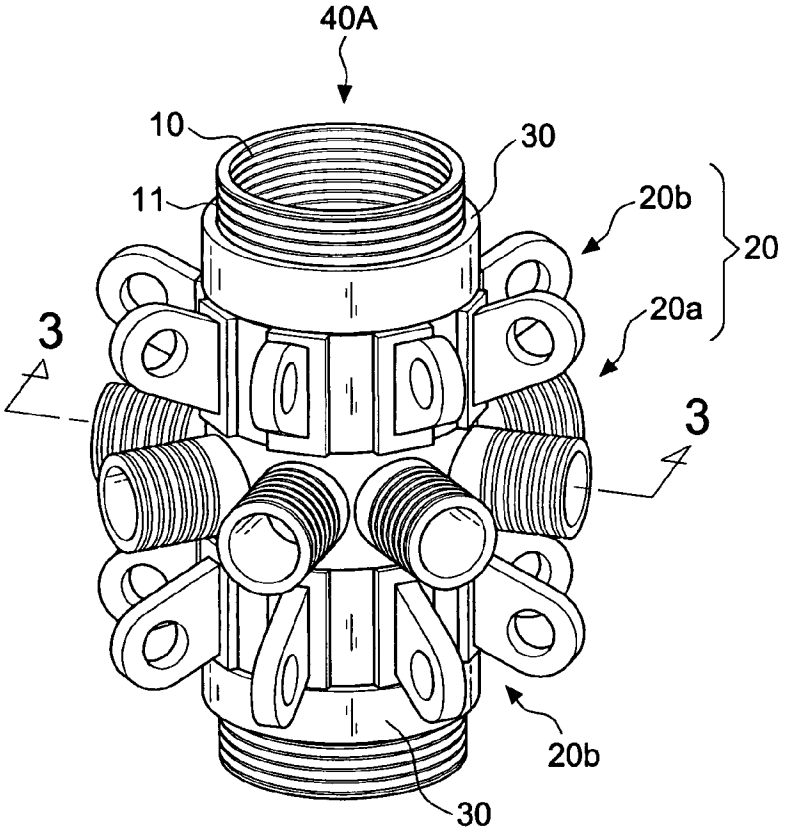
FIG. 2 is a perspective view of a first preferred embodiment of the invention.
Figure 3B:
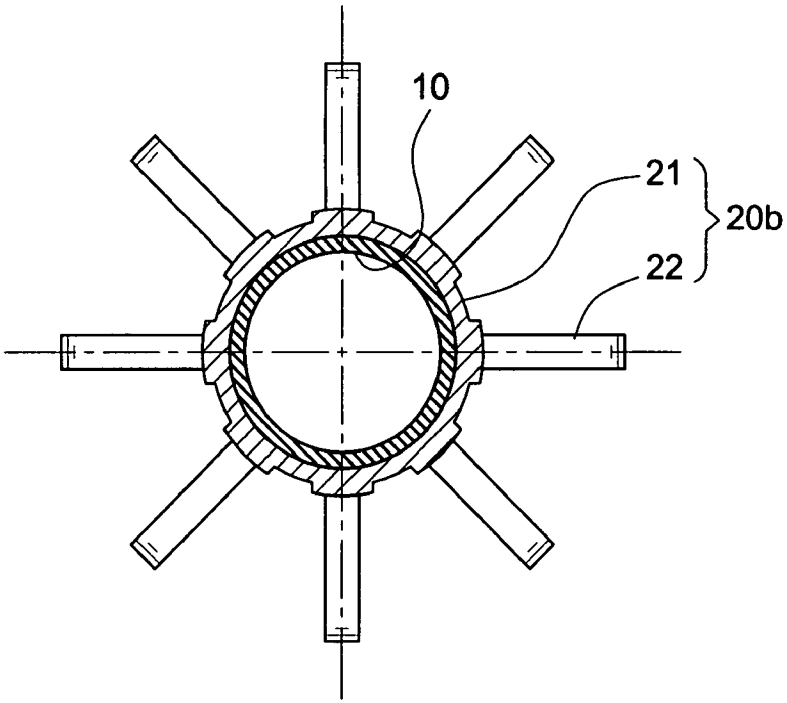
FIG. 3B is a cross-section view of Section 3B-3B as depicted in FIG. 2.
Figure 3A:
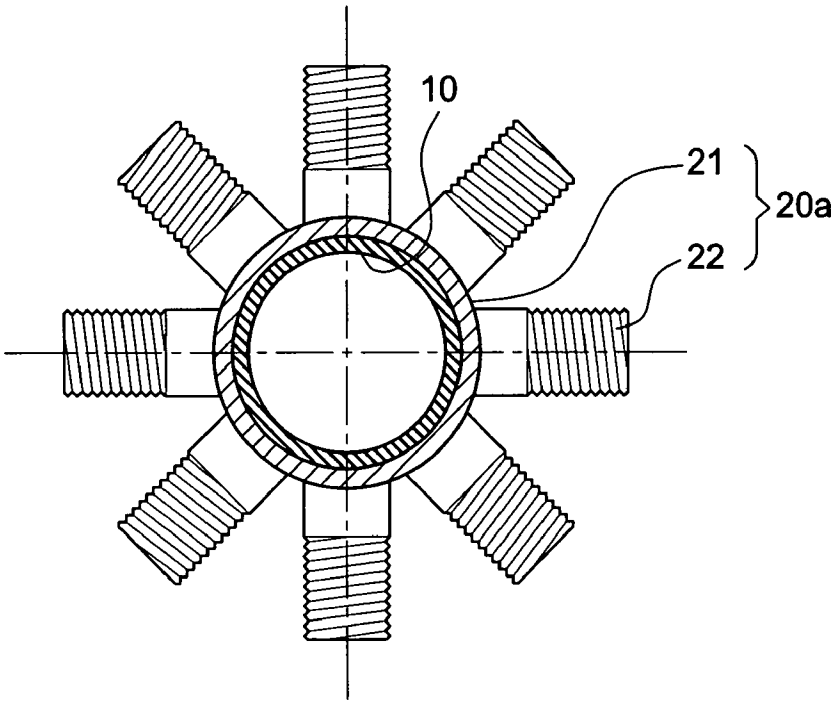
FIG. 3A is a cross-section view of Section 3A-3A as depicted in FIG. 2.

With reference to FIGS. 1 to 4B, a first preferred embodiment of the present invention comprises the following elements:

A framework 10 is an axial rod in a predetermined shape, and acts as a main body of a core of the whole connector 40A, and includes a threaded body disposed individually at upper and lower ends of an axial coupling portion 11, but not limited to such arrangement only.

A multi-level protruded connecting base 20 includes a base body installed at an outer peripheral surface of the framework 10, and the protruded connecting base 20 of this preferred embodiment includes a middle-level protruded connecting base 20*a* and upper-level and lower levels protruded connecting base 20*b*, and the base body at each level of the protruded connecting base 20 is a ring body 21. In other words, the ring body 21 of this preferred embodiment is the base body of the protruded connecting base 20 sheathed onto the outer peripheral surface of the framework 10 by a sheathing method, and the ring body 21 at different levels includes a plurality of protruding bodies 22, 23 extended from different positions and directions for a connection. The protruding bodies are in a circular shape, a square shape and/or a polygonal shape, and each has a thread, a screw hole or a latch slot thereon. In this preferred embodiment, the middle-level protruding body 22 is a horizontally extended threaded body, and the upper-level protruding body 22 is an upwardly tilted lug 23, and the lower-level protruding body 22 is a downwardly titled lug 23. In other words, the three levels of protruding bodies are installed in different directions, positions, and angles.

Figure 4A:
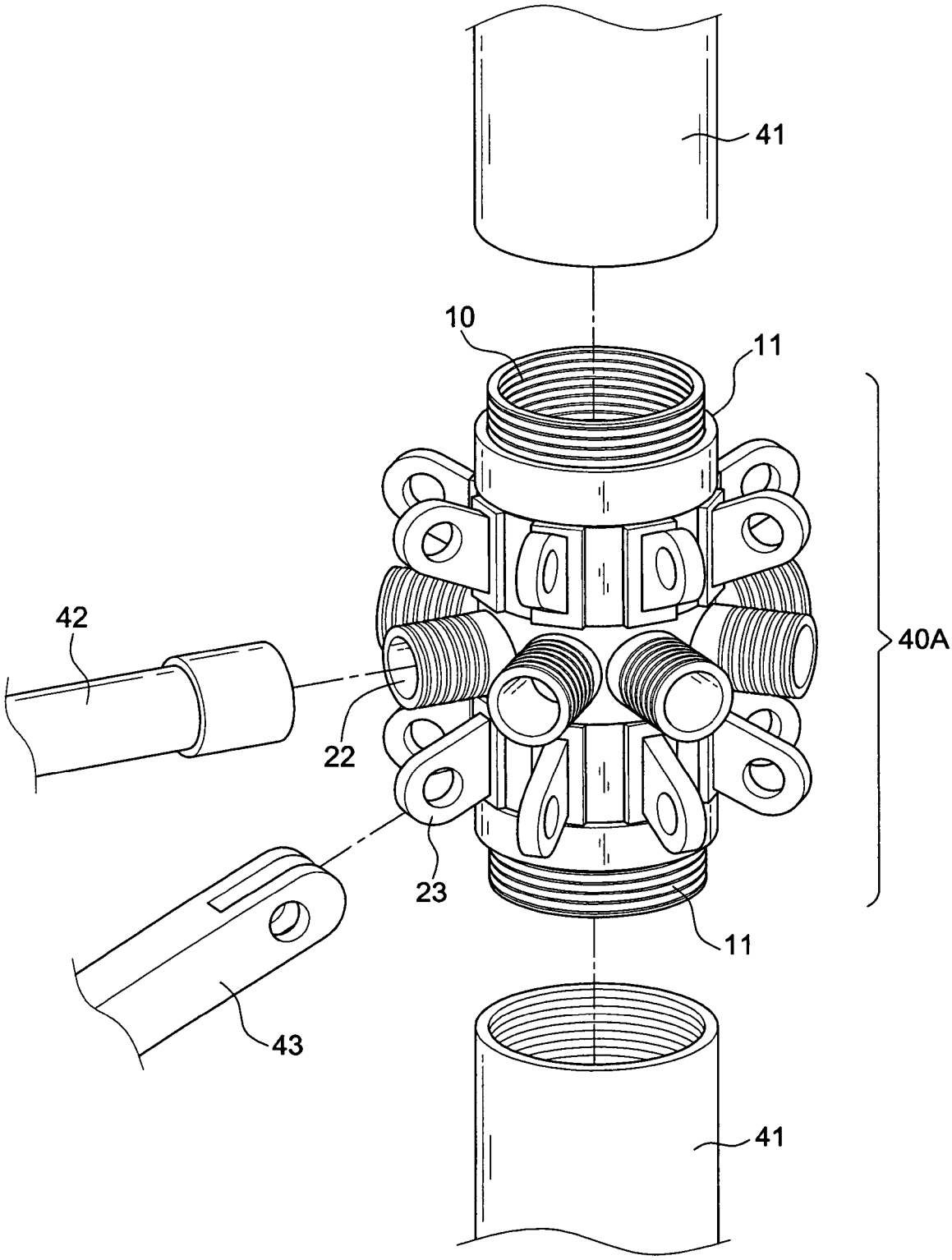
FIG. 4A is a schematic view of combining a connector with a connecting element in accordance with a first preferred embodiment of the present invention.
Figure 4B:
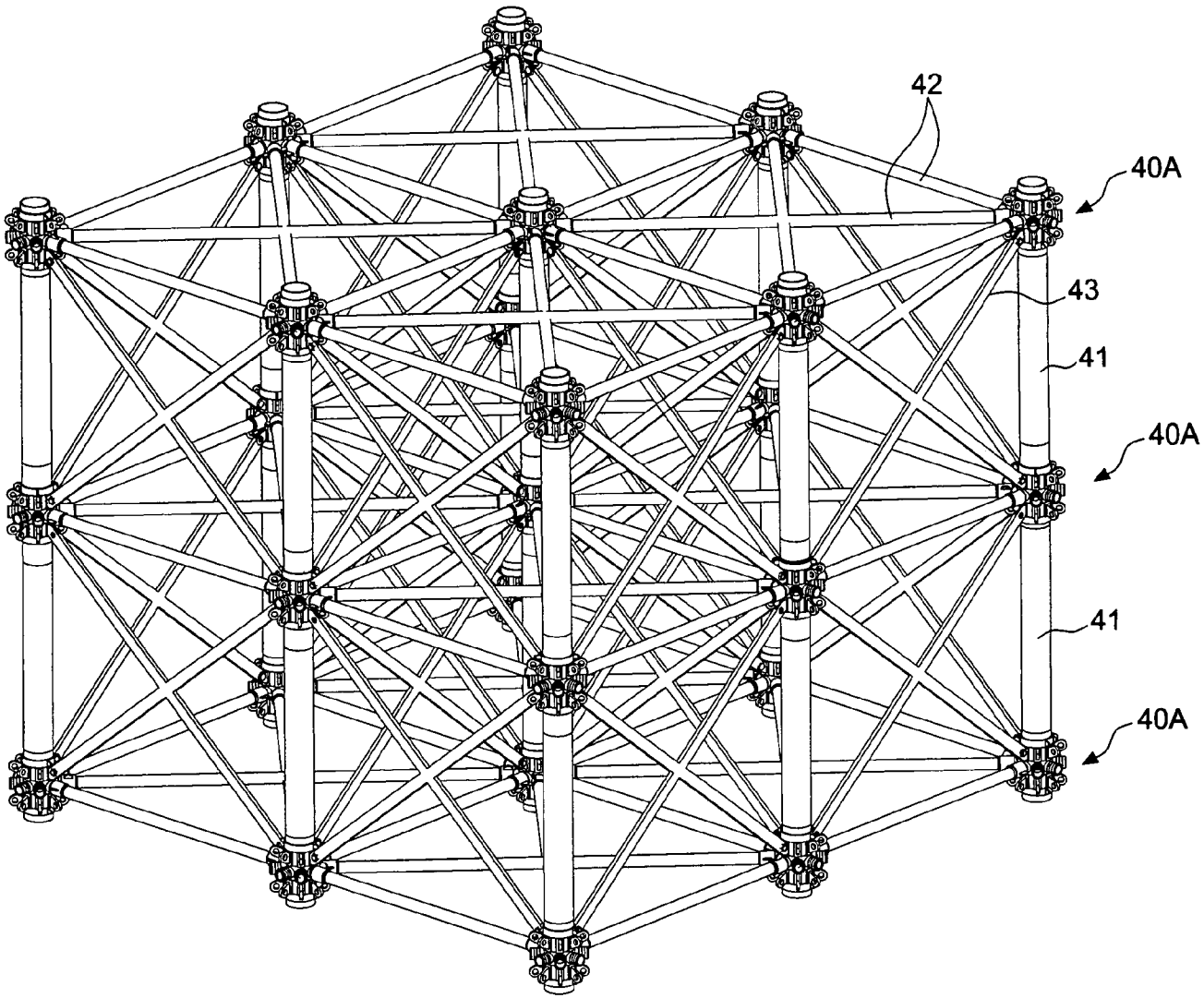
FIG. 4B is a schematic view of an application in accordance with a first preferred embodiment of the present invention.

In this preferred embodiment, at least two positioning elements 30 are screws axially secured to the axial coupling portion 11 at the upper and lower ends of the framework 10 for connecting a plurality of protruded connecting bases 20*a*, 20*b* onto the framework 10 in series. The positioning elements 30, the axial coupling portion 11 and the framework 10 are assembled to form a structure of a connector 40A. Now, the axial coupling portions 11 at the upper and lower ends of the framework 10 are exposed from the positioning element 30 as shown in FIGS. 4A and 4B, and the axial coupling portion 11 and the protruding bodies 22, 23 radially extended from different directions, positions, and angles from each connector 40A can be connected by an axial pipe 41 and lateral connecting elements 42, 43 to form a spatial structure in a predetermined shape as shown in FIG. 4B.

Figure 4C:
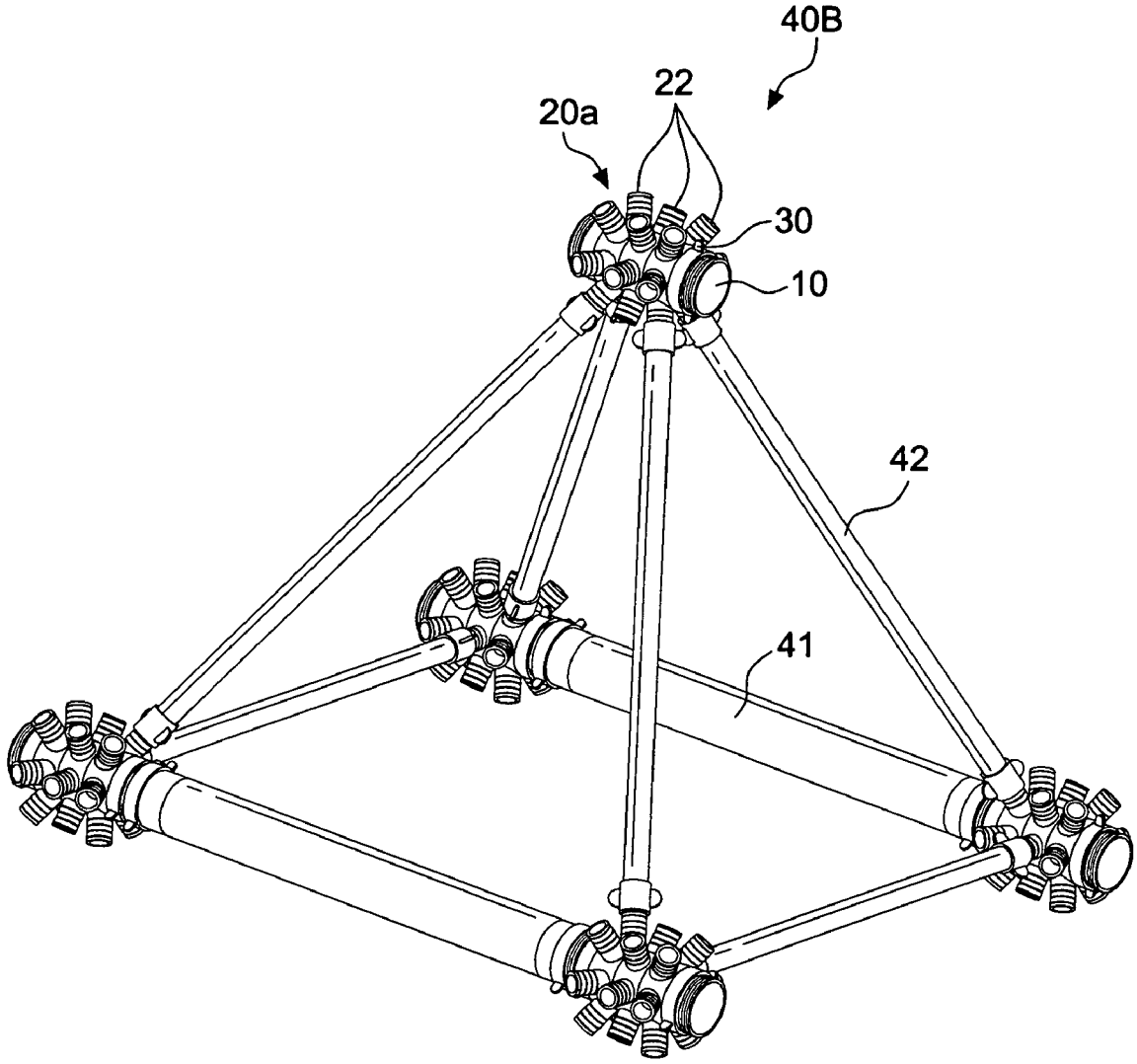
FIG. 4C is a schematic view of an application in accordance with a second preferred embodiment of the present invention.
Figure 4D:
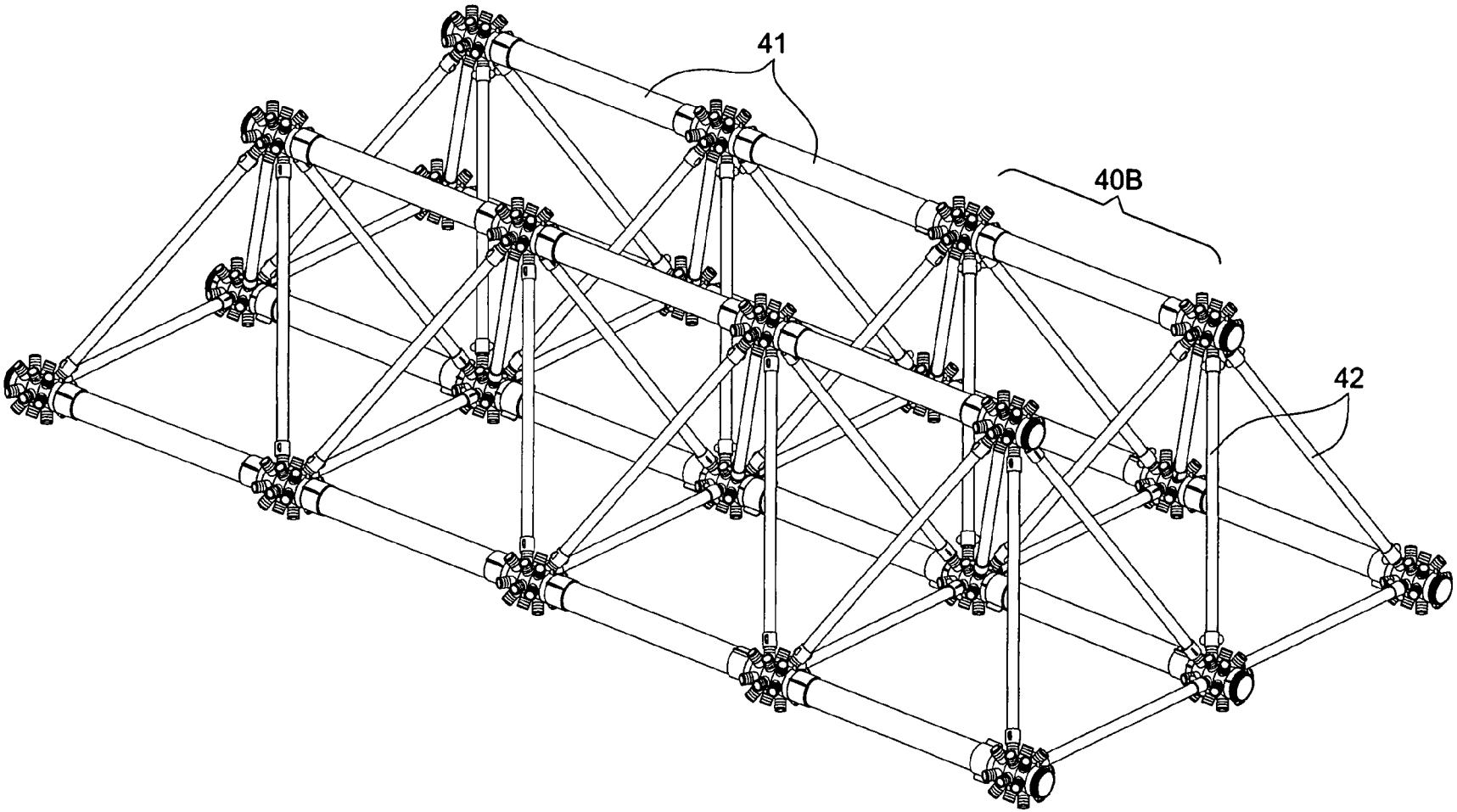
FIG. 4D is a schematic view of another application in accordance with a second preferred embodiment of the present invention.

With reference to FIGS. 4C and 4D for a second preferred embodiment of the present invention, same numerals are used for the same elements of the previous preferred embodiment, and the difference of this preferred embodiment from the previous preferred embodiment resides on that the protruding bodies 22 extended from different directions and angles from the three levels of the protruded connecting base 20*a* of the connector 40B are threaded bodies, and the remaining elements are all the same as those of the first preferred embodiment and thus will not be described here.

Figure 5:
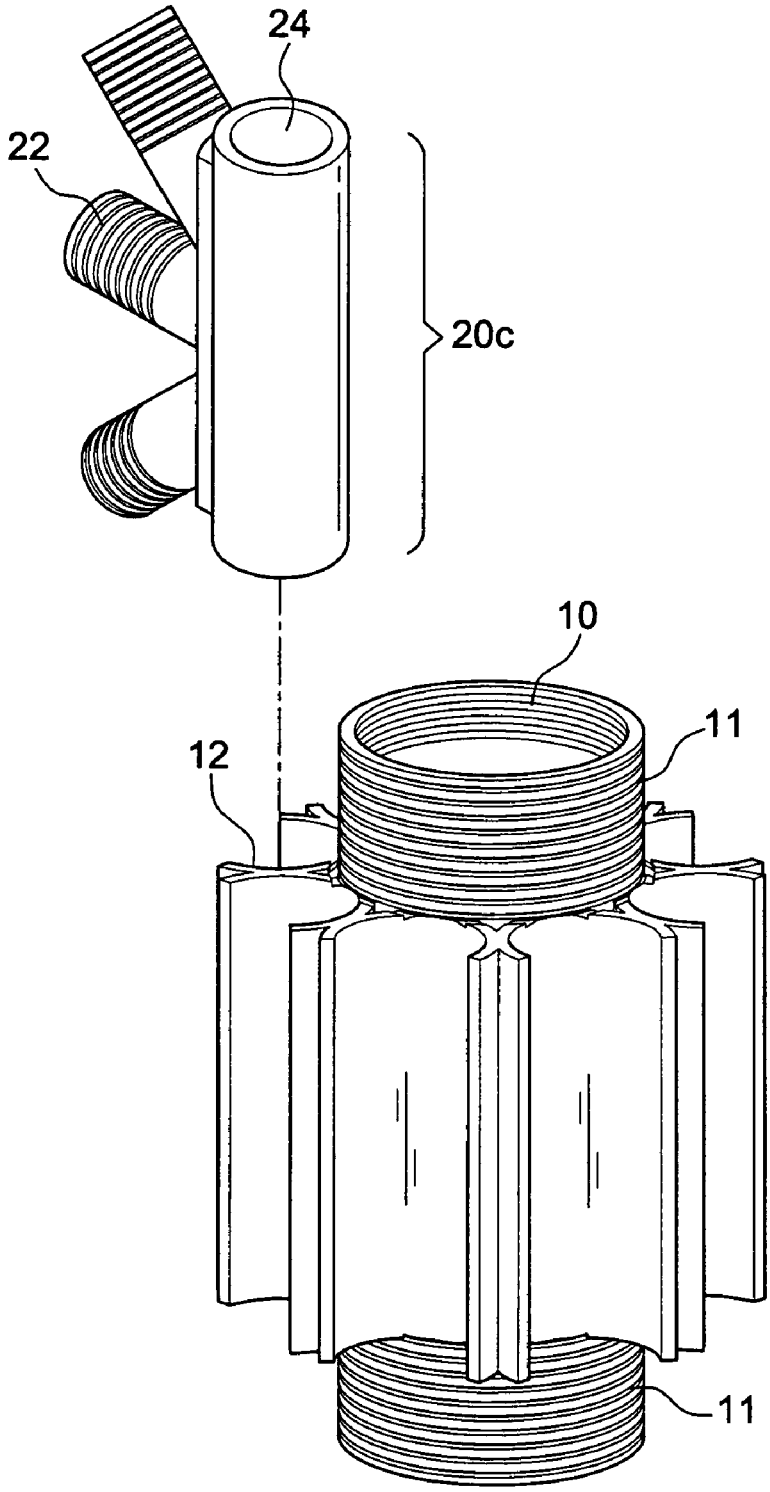
FIG. 5 is an exploded view of a third preferred embodiment of the invention.
Figure 6:
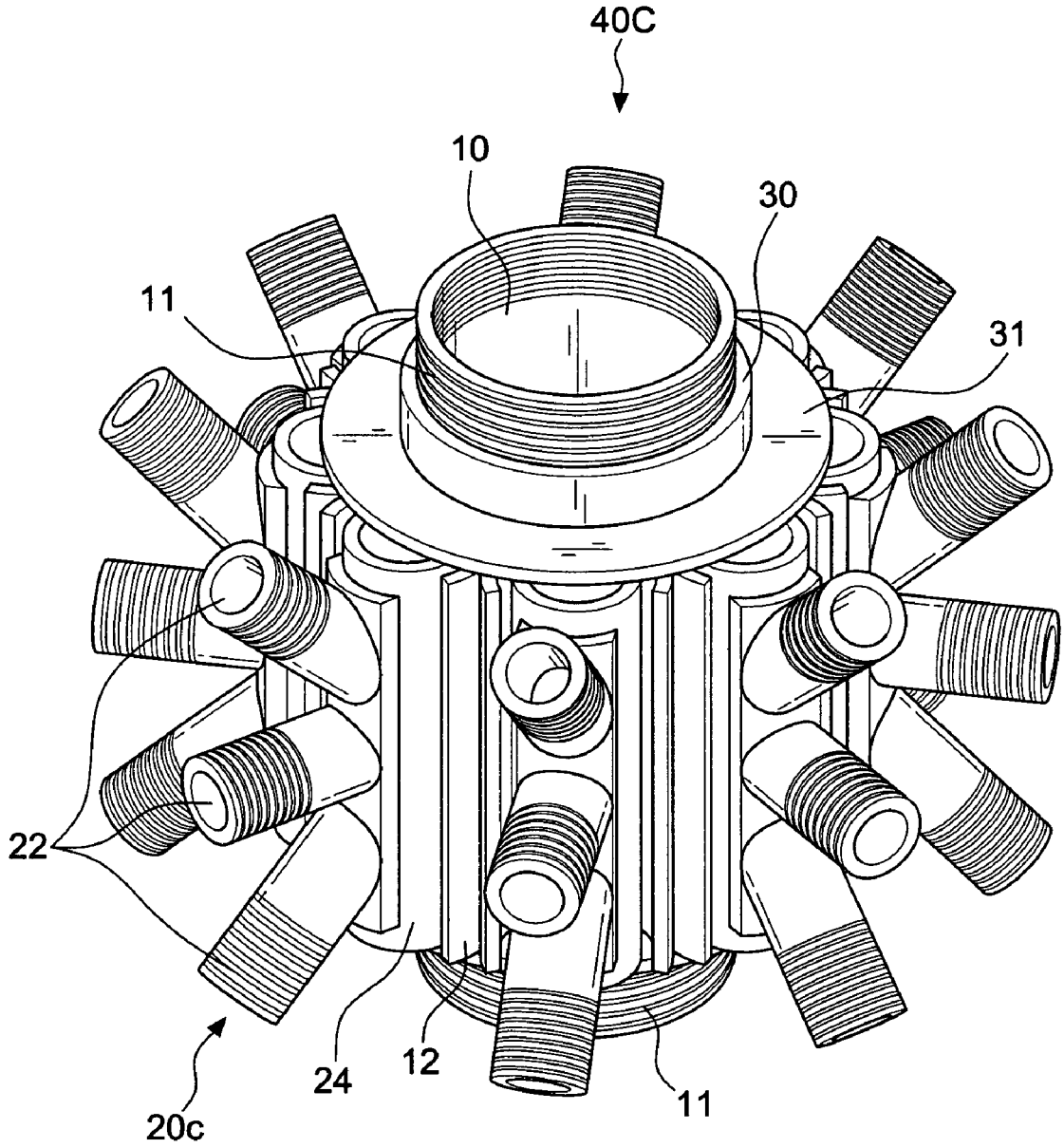
FIG. 6 is a perspective view of a third preferred embodiment of the invention.

With reference to FIGS. 5 and 6 for a third preferred embodiment of the present invention, same numerals are used for the same elements of the previous preferred embodiments, and the difference between this preferred embodiment and the previous preferred embodiments resides on that the framework 10 comprises an axial coupling portion 11 disposed individually at both upper and lower ends of the framework 10 and formed as a threaded body, and a plurality of outwardly and axially extended latch slots 12 disposed around an external periphery of the framework 10. The base body of the protruded connecting base 20*c* includes an axial wedge 24 embedded into the latch slot, and a plurality of protruding bodies 22 extended in different directions and disposed at an external surface of the axial wedge 24, and the two positioning elements 30 are screws and each has a press surface 31 for setting a plurality of embedding rings axially onto the protruded connecting bases 20*c* of the latch slot 12 for a connection in an axial direction, so as to form a connector 40C as shown in FIG. 6. The difference between this embodiment and the aforementioned embodiments resides on that the protruded connecting base 20C is connected with the framework 10 by a non-sheathing method, and latched radially around the outer peripheral surface of the framework 10 and positioned in compliance with the upper and lower positioning elements 30.

Figure 7:
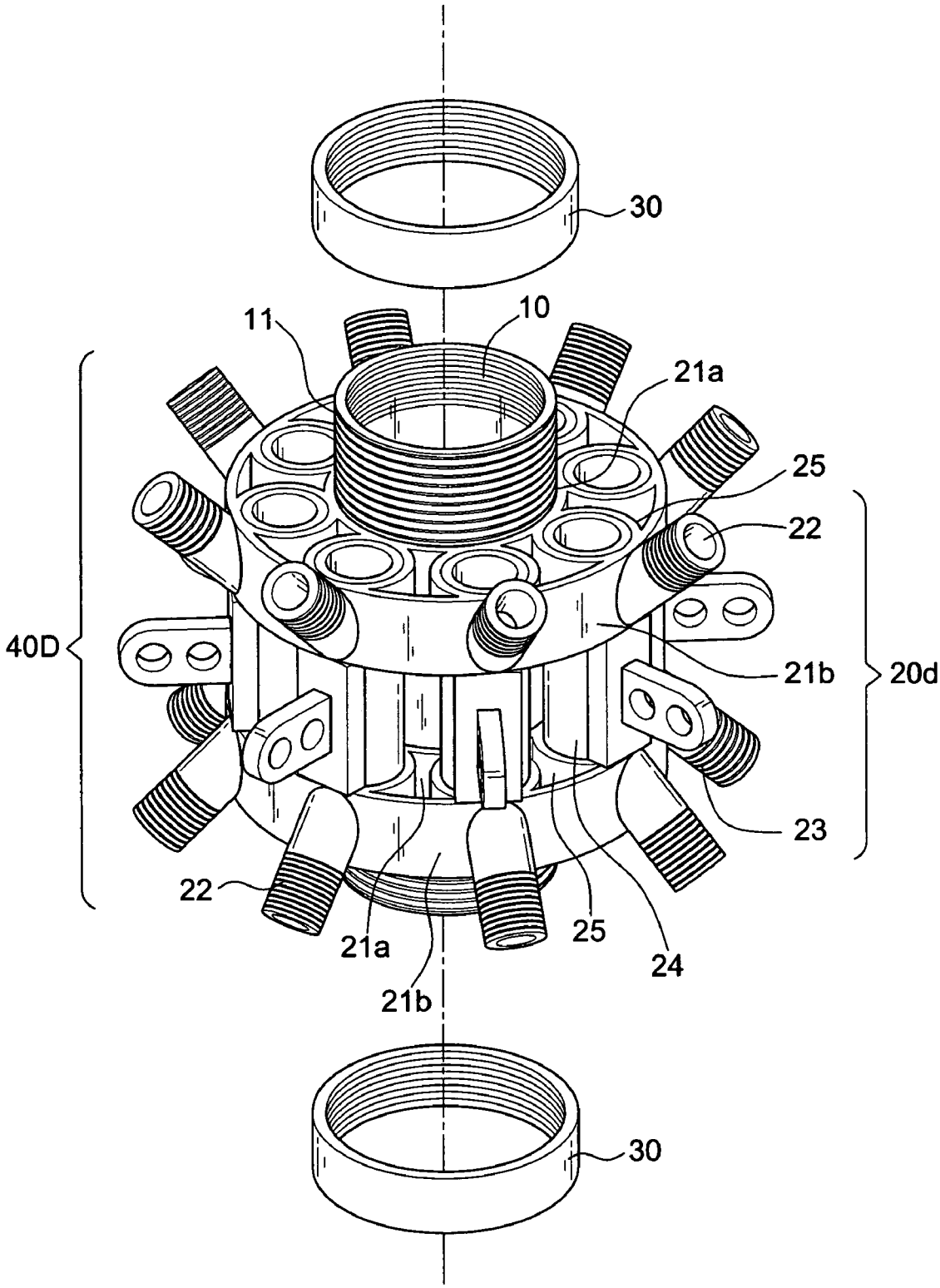
FIG. 7 is a perspective view of a fourth preferred embodiment of the invention.

With reference to FIG. 7 for a fourth preferred embodiment of the present invention, the axial coupling portion 11 individually disposed at both upper and lower ends of the framework 10 includes a threaded body, and a plurality of levels of protruded connecting bases 20*d* disposed on an external periphery of the axial coupling portion 11 and connected axially with each other in series, wherein the upper-level and lower-level of the protruded connecting bases include internal and external rings 21*a*, 21*b*, and a plurality of axial positioning holes 25 for connecting the internal and external rings 21*a*, 21*b*, and the internal ring 21*a* is sheathed onto an outer peripheral surface of the framework 10, and the external periphery of the external ring 21*b* has a plurality of extended protruding bodies 22. The middle-level protruded connecting base includes an axial wedge 24, with its upper and lower ends embedded into the axial positioning holes 25 of the upper-level and lower-level protruded connecting bases respectively, such that the three levels of protruded connecting bases can be combined into a complex protruded connector 40D, and the two positioning elements 30 are screws for securing the complex protruded connector 40D onto the framework 10.

Figure 9:
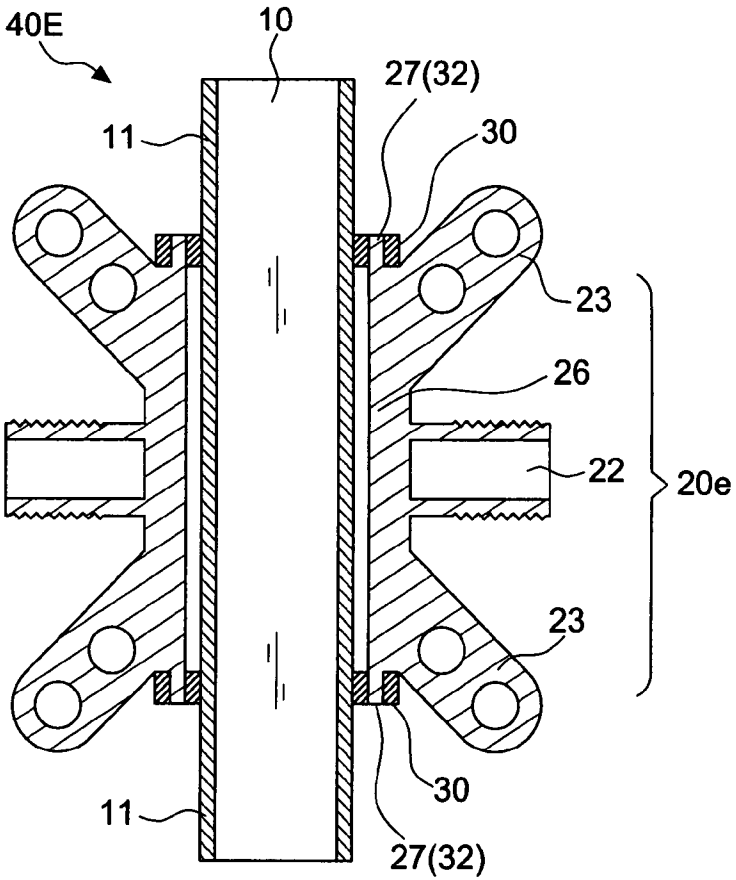
FIG. 9 is a cross-sectional view of Section 9-9 as depicted in FIG. 8.
Figure 8:
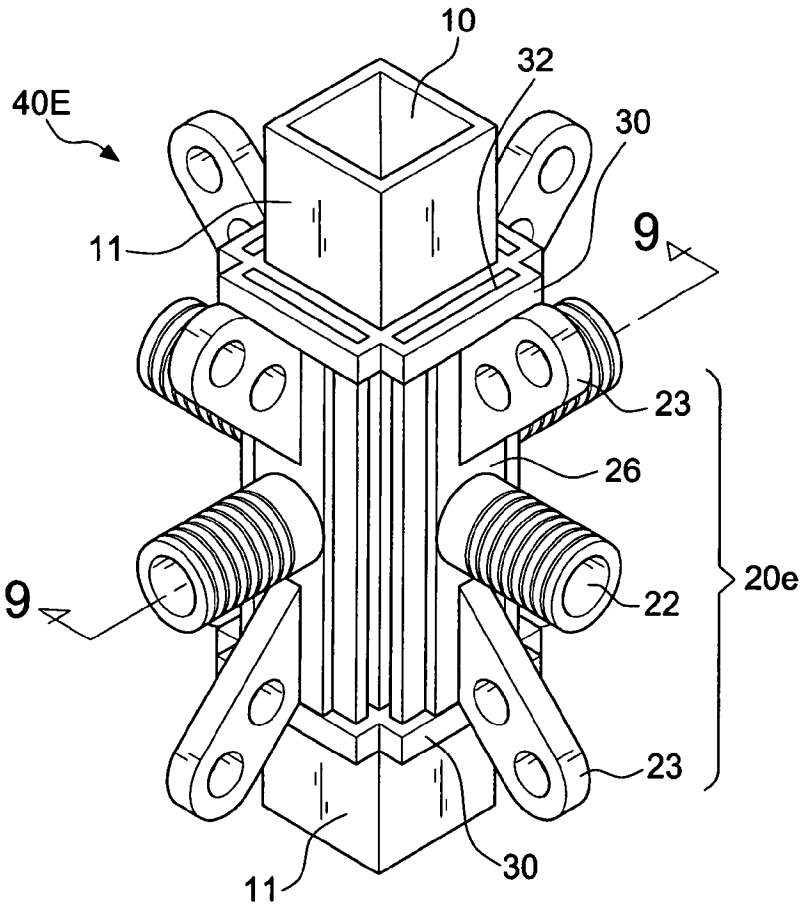
FIG. 8 is a perspective view of a fifth preferred embodiment of the invention.

With reference to FIGS. 8 and 9 for a fifth preferred embodiment of the present invention, the framework 10 of the complex protruded connector (40E) is a square body, and the base body of the protruded connecting base 20*e* has an axial wedge 26, which is a plate in this preferred embodiment, and the axial wedge 26 includes a plurality of protruding bodies 22, 23 extended in different directions, positions, and angles from an external surface of the axial wedge 26, and each side of the two positioning elements 30 has a latch slot 32 aligned corresponding to an end portion 27 of the axial wedge 26 and individually fixed to the upper and lower ends of the framework 10, and the corresponding upper and lower latch slots 32 are provided for fixing the plurality of protruded connecting bases 20*e* onto the framework 10.

The aforementioned preferred embodiments adopt a connector comprised of the framework, the protruded connecting base and the positioning element in accordance with the present invention, wherein the protruded connecting bases 20*a*, 20*b* of the first and second preferred embodiments can be rotated freely in any angle with respect to the framework 10, and then fixed into their positions. The protruded connecting base 20*c* of the third preferred embodiment can be adjusted to a limited angle in the C-shaped axial latch slot 12. In the complex protruded connector 40D of the fourth preferred embodiment, the upper-level and the lower-level protruded connecting bases can be rotated freely in any angle with respect to the framework 10, and the middle-level protruded connecting base can be adjusted to a limited angle. The protruded connecting base 20*e* of the fifth preferred embodiment is fixed completely and cannot be rotated or adjusted with any angle. Therefore, the aforementioned preferred embodiments have their own features, and can be used selectively as needed.

While the invention has been described by means of specific embodiments, numerous modifications and variations could be made thereto by those skilled in the art without departing from the scope and spirit of the invention set forth in the claims.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An integrally assembled changeable framework connector used for a spatial structure, comprising:

a) a framework, formed by an axial rod including a predetermined quantity of protruded connecting bases and a predetermined quantity of positioning elements at an intermediate position thereof, wherein the framework is in a predetermined shape and acts a main body of the whole connector;

the protruded connecting base includes a base body having a ring body sleeved onto the framework, and a protruding body extended radially outward from a surface of the framework and having a plurality of levels provided for connections in different directions, and the protruding bodies including bodies in a same shape or different shapes; and b) at least two positioning elements, installed to upper and lower ends of the framework axially and respectively, such that the upper and lower ends of the framework constitute an axial coupling portion, and two upper and lower positioning elements fix the protruded connecting base onto the framework, and the three constitute a connector, and the axial coupling portion and radially extended protruding bodies of different directions, positions, and angles between corresponding connectors are assembled by axial pipes and lateral connecting elements to form a spatial structure in a predetermined shape.

2. The integrally assembled changeable framework connector used for a spatial structure as recited in claim 1, wherein the framework includes a coupling portion having a threaded body and being disposed individually at both upper and lower ends of the framework, and the base body of the protruded connecting base is rotatable about the outer peripheral surface of the framework, and a plurality of extended protruding bodies are disposed around the periphery of the ring body, and the two positioning elements are screws provided for connecting the plurality of protruded connecting bases onto the framework in series, so as to form a connector (40A), (40B).

3. The integrally assembled changeable framework connector used for a spatial structure as recited in claim 2, wherein the extended protruding body of the protruded connecting base is in a circular shape, a plate-shape or a polygonal shape, and includes a thread, a screw hole or a latch slot with an angle extended horizontally, tilted upward, or tilted downward.

4. The integrally assembled changeable framework connector used for a spatial structure as recited in claim 1, wherein the axial coupling portion disposed individually at both upper and lower ends of the framework includes a threaded body, and a plurality of latch slots extended outwardly and axially and disposed around an external periphery of the framework, and a base body of the protruded connecting base includes an axial wedge embedded into the axial latch slot, and a plurality of protruding bodies extended in different directions and disposed on an external surface of the axial wedge, and the two positioning elements are screws, each having a press surface, for setting a plurality of embedding rings to the protruded connecting base of the axial latch slot for an axial connection, so as to form a connector (40C).

5. The integrally assembled changeable framework connector used for a spatial structure as recited in claim 1, wherein the coupling portion disposed individually at both upper and lower ends of the framework includes a threaded body, and a plurality of levels of protruded connecting bases disposed on an external periphery of the coupling portion and connected in series with each other, and a base body of the upper-level and lower level protruded connecting bases includes internal and external rings, and a plurality of axial positioning holes disposed between the internal and external rings, and the internal ring is sheathed onto an outer peripheral surface of the framework, and a plurality of protruding bodies are extended from an external periphery of the external ring, and the middle-level protruded connecting base includes an axial wedge with upper and lower ends embedded into the axial positioning holes of the upper-and lower-level protruded connecting bases, such that the three levels of protruded connecting bases are combined into a complex protruded connector (40D), and the two positioning elements are screws provided for fixing the complex protruded connector (40D) onto the framework.

6. The integrally assembled changeable framework connector used for a spatial structure as recited in claim 1, wherein the framework of the complex protruded connector (40E) is a square body, and the base body of the protruded connecting base includes an axial wedge, and a plurality of protruding bodies extended in different directions, positions, and angles and disposed on an external surface of the axial wedge, and each side of the two positioning elements is aligned corresponding to an end portion of the axial wedge, and includes a latch slot for fixing the upper and lower ends of the framework respectively, and the corresponding upper and lower latch slots are provided for fixing the plurality of protruded connecting bases onto the framework.

* * * * *